US005870837A

United States Patent [19]

Poulos

[11] Patent Number: 5,870,837

[45] Date of Patent: Feb. 16, 1999

[54] COMBINATION PEDICURE SANDAL

[76] Inventor: Jon D. Poulos, 23 Cambria Rd., Palm Beach Gardens, Fla. 33418

[21] Appl. No.: 907,574

[22] Filed: Aug. 8, 1997

[51] Int. Cl.[6] ..... A43B 3/12; A43B 21/36; A43B 7/14

[52] U.S. Cl. ..... 36/11.5; 36/94; 36/88

[58] Field of Search ..... 36/11.5, 88, 94, 36/71, 95, 138, 106

[56] References Cited

U.S. PATENT DOCUMENTS

| | | | |
|---|---|---|---|
| 1,867,679 | 7/1932 | Riehle et al. | 36/11.5 |
| 2,506,308 | 5/1950 | Maynier | 36/11.5 |
| 2,751,693 | 6/1956 | Baker | 36/11.5 |
| 2,808,662 | 10/1957 | Webb | 36/11.5 |
| 4,017,987 | 4/1977 | Perez, Jr. . | |

*Primary Examiner*—Paul T. Sewell
*Assistant Examiner*—Anthony Stashick
*Attorney, Agent, or Firm*—McHale & Slavin, PA

[57] ABSTRACT

The pedicure sandal combination footwear is disclosed which provides a toe divider that is releasably secured to a sandal so as to maintain the toes in a predetermined position. The sandal includes a bridge strap that opens to allow the vertical placement of a foot onto the base member by use of the hook & pile attachment thereby allowing an individual to first position the toe divider onto the foot before placement of the foot onto the sandal. Once the foot is properly positioned the bridge straps may be wrapped around the foot so as to secure the foot in a fixed position.

7 Claims, 1 Drawing Sheet

COMBINATION PEDICURE SANDAL

FIELD OF THE INVENTION

This invention relates generally to footwear and more particularly to an improved sandal providing an adjustable bridge and toe divider.

BACKGROUND OF THE INVENTION

A sandal is a type of footwear commonly used in an informal setting to protect an individual's feet. For instance, a barefoot individual is susceptible to the pain of stepping on a sharp rock, hot sand, or even hot seeping tar. The typical result is injury or contamination of the feet. In many instances it is not an acceptable practice to walk barefoot, and food establishments typically ban patrons who fail to wear footwear. For this reason, sandals have become a convenient form of footwear to protect an individual's feet yet providing a near barefoot experience.

Sandals may also be used to assist a beautician during a pedicure. U.S. Pat. No. 4,017,987 discloses a pedicure sandal having a base with four toe prongs extending out of the base for placement between the toes. Each prong maintains the toes in a spaced apart position. This assists a beautician in performing a pedicure by inhibiting the toes from touching and further allowing for the proper application of nail polish. By use of the pedicure sandal, an individual may immediately walk or drive a car with freshly polished toes. This eliminates the need for waiting up to an hour at a salon while the nail polish drys. However, even if the polish drys within an hour, it is known that the polish can still easily scratch should the individual immediately put on tight fitting shoes. The problem with the pedicure sandal of the prior art is that the toe positions are fixed and requires an individual to place their foot within the sandal which, by itself could damage the nail polish. The fixed prongs require the individual to wear the sandal throughout the entire pedicure process. If the sandal had been worn before, the bottom of the sandal could be contaminated and the beautician may refuse to work on the foot with the sandals in place. Even if the sandal is clean, the sandal is larger than the foot and is difficult to work with. If the sandal is installed after the pedicure, the individual must place their foot through a fixed strap and then insert the prongs between the toes. Any incorrect movement will cause the nail polish to be affected.

Thus what is lacking in the art is a combination pedicure sandal which allows for the separation of toes before or after the placement of a foot within a sandal and includes an adjustable bridge strap to ease insertion of the foot.

SUMMARY OF THE INVENTION

The instant invention is an improved sandal having an adjustable bridge strap that also separates to allow for the placement of a foot within the sandal in a vertical position. The open strap eliminates the need for sliding a foot beneath a bridge strap. In addition, the sandal employs a detachable toe divider for use in maintaining the toes in a separate position.

The toe divider may be used separate from the sandal during a pedicure process and then secured to the sandal to maintain the toes in a spaced apart position. This allows the multiple reuse of a sandal without requiring a beautician to work around the rest of the sandal. The bridge strap can be separated to allow for the insertion of the foot, with the toe divider placed between the toes, and then secure the foot in position. Once the nail polish has dried, the toe divider may be removed and allow the individual to continue wearing the sandal.

Alternatively, the toe divider may be first secured to the sandal wherein the foot and toes are held in position for the pedicure procedure. It should be noted that, even though the main embodiment of the invention is directed to pedicures, the sandal may also be used for individuals who have injured one or both feet. In such an instance, it may be necessary for an individual to use a sandal which places no pressure on the toes yet allows for the fixed positioning of the toes. Should an individual have foot surgery, the bottom of the individual's foot may be protected after the surgery while the upper portion of the foot is exposed to allow for fast recovery. The toe divider providing a fixed positioning of the toes to facilitate recovery.

Thus an objective of the instant invention is to teach an improved sandal that allows an individual having a pedicure to first position the toes in a spaced apart position before securement to a sandal.

Another objective of the instant invention is to disclose a sandal having a detachable bridge that allows for the vertical placement of the foot.

Still another objective of the instant invention is to teach a combination sandal that allows for removal of a toe separating device allowing for use of a sandal in an ordinary and conventional manner.

Yet still another objective of the instant invention is to teach a combination sandal that allows for total or partial toe stabilization.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
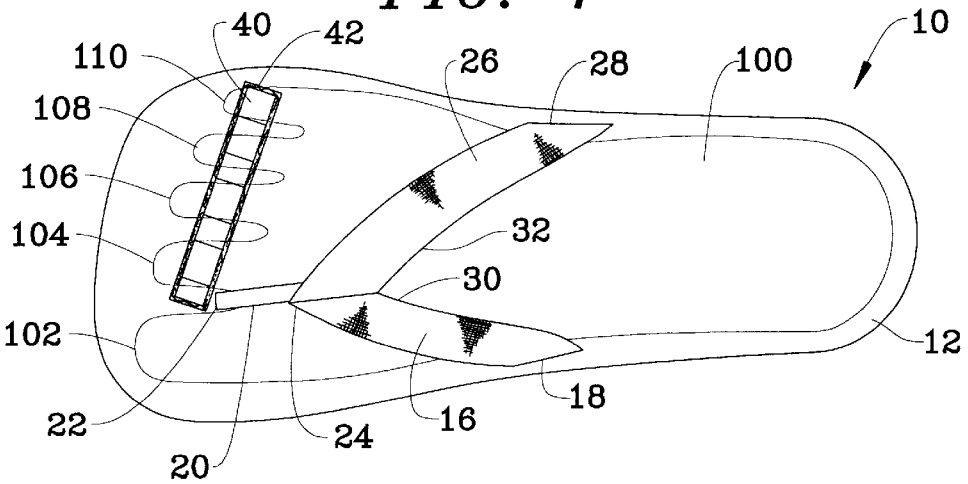
FIG. 1 is a top view of the improved sandal.

Referring now to FIG. 1, set forth is the pedicure sandal combination 10 of the instant invention having a base 12 constructed from sponge rubber or the like material that provides for the cushioning of the foot when worn as footwear. The shape of the base substantially conforms to the shape of a human foot. Various size bases are available for convenience but not necessary for operation since an adjustable bridge and moveable toe securement allows the sandal to be worn on any size foot. A first bridge strap 16 is permanently secured along an edge 18 of the base 12 with a bridge stand 20 having a upper end secured to a distal end 24 of strap 16 and a bottom end 22 permanently secured to the base 12. A second bridge strap 26 is permanently secured to the base 12 along bottom edge 28 and releasably secured to the upper portion 30 of strap 16 along edge 32 by the use of a hook & pile attachment. The detachment of the straps, 16 and 26 allow a foot to be placed into the base 16 in a vertical unobstructed manner.

A toe divider 40 is formed from a soft flexible sponge rubber material having a pre-formed shape so as to cause a separation of an individual's toes. The divider 40 is releasably secured to the base 12 by the use of a hook & pile attachment. The pile portion 42 of the attachment is permanently secured to the base 12, the hook portion, not shown, is positioned beneath the divider 40. The divider 40 is releasably secured to the pile 42 where it is maintained in a secure fixed position. An individual may place their foot onto the base, as depicted by numeral 100, by first separating bridge straps 16 and 26 and placing the large toe around bridge strap support 20. The remaining toes are placed between the dividers with the smallest toe 110 placed on the outer surface of the sponge rubber.

The teaching of this device is to further provide for placement of the sponge rubber material between the toes before the foot 100 is placed onto the base 12. In this manner the sponge rubber may be positioned between the toes allowing the beautician to perform the pedicure without being hampered by the sandal. The beautician may further polish the nails, with the foot being highly mobile while the toes are maintained in a fixed, spaced apart position. The foot can then be placed onto the sandal as toes 104, 106, 108 are in the separated position by opening of straps 16 and 26 which allow for the placement of the foot 100 directly onto the base 12. Insertion requires the large toe 102 to be placed around the strap bridge 20 while toe support 40 is positioned onto the pile 42 of the hook & pile attachment. This allows an individual to have their toes in a pre-set position before placement onto the footwear. Once the toe divider 40 is properly positioned onto the pile 42, bridge straps 16 and 26 may be secured together to encompass an individual's foot. Bridge adjustment further allows for the proper securement of the sandal to the foot size.

Figure 2:
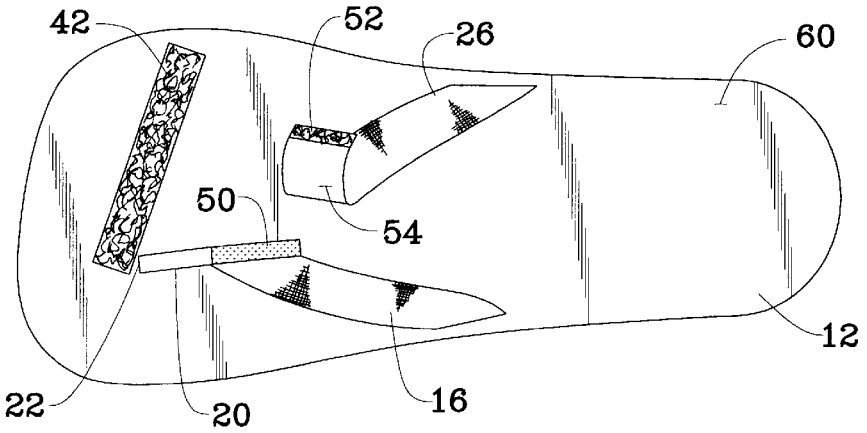
FIG. 2 is a top view of the improved sandal illustrating an open bridge strap.

FIG. 2 depicts the base 12 with the proximal ends of the first bridge strap 16 and the second bridge strap 26 secured to the base and the distal ends placed in an open position. Distal end 22 includes a hook & pile attachment 50 along an outer surface and a reciprocal hook and pile attachment 52 along an inner surface 54 of strap 26. The first and second strap 16, 26 are separated by detaching the hook & pile attachment 50 and 52 so as to allow an individual's foot to be placed between the straps in a vertical manner. The upper surface 60 of the base 12 includes a pile attachment 42 section which allows an individual to position the toe divider 40 at any angle particular to the individual's feet. Removal of the toe divider 40, permits use of the sandal in an ordinary and conventional manner. The bridge strap 20, shown secured to the base 12 and first strap 16, provides securement of the foot. The bridge strap 20 fits between the first 102 and second toe as illustrated in FIG. 1.

Thus, an individual having a pedicure may have the salon install the toe divider in a particular position and assist the consumer in placing their foot into the sandal. The toe divider maintaining the toes in a spaced apart position until the pedicure is finished and the toe polish drys. The individual wearing the sandal may move about since the toes are secured thereby preventing toe polish imperfections. Once the toe polish is dry, the individual may remove the toe divider and continue to wear the sandals. In this manner, the entire upper surface 60 of the base 12 may be made of a felt-like material allowing the entire surface to be receptive to the hook attachment, commonly known under the trademark VELCRO.

Alternatively, the toe divider may employ a bottom surface formed in a tongue and groove shape, not shown. The base would include a groove with the toe divider having a reciprocal tongue shape that causes an interlock therebetween. The interlock would again allow for the removal of the toe divider for use during the pedicure and for the slidable insertion into the base for securement of the toe divider. Similarly, removal of the divider allows the sandal to be used in its ordinary manner.

Figure 4:
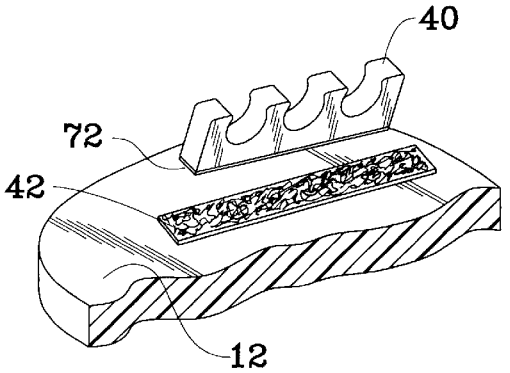
FIG. 4 is a partial top view of the toe divider detached from the base of the sandal.
Figure 3:
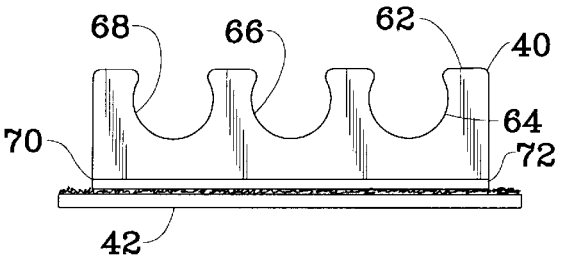
FIG. 3 is a side view of the toe divider.

Now referring to FIG. 3 is the toe separating structure 40 having an upper surface 62 with a first 64, a second 66, and a third 68 indentation which allows for the positioning of the individual toes. Each indentation is circular in shape with the upper surface 62 being enlarged so as to prevent dislodgement of the toes while the individual is walking. A bottom surface 70 of the toe structure includes the hook portion 72 of the hook & pile attachment which is releasably securable to the pile portion 42 which is permanently secured to the upper surface 60 of the base 12. Similarly the hook portion 72 is permanently secured to the lower surface 70 of the toe divider structure. As shown in FIG. 4 the toe separating structure 40 is releasably secured to the base 12 by securement to the felt portion 42 secured to the base wherein the pile portion 72 of the toe structure 40 provides for the secure attachment thereto.

It is to be understood that while a certain form of the invention is illustrated, it is not to be limited to the specific form or arrangement of parts herein described and shown. It will be apparent to those skilled in the art that various changes may be made without departing from the scope of the invention.

What is claimed is:

1. An improved sandal characterized by a base formed from flexible foam rubber materials having a cushioned upper surface, a lower surface providing ground abrasion resistance and an outer perimeter edge shaped to accommodate a human foot, said improvement comprising:

an adjustable bridge strap, said strap formed from a first strip of flexible material having a proximal end secured to said base adjacent to a first side surface of said outer perimeter edge and a distal end extending outwardly therefrom, and a second strip of flexible material having a proximal end secured to said base adjacent to a second side surface of said outer perimeter edge and a distal end extending outwardly therefrom, each said distal end including an attachment means for coupling together;

a toe separating structure, said structure formed from a single piece of material having a rectangular shape with an upper surface and a lower surface, said upper surface having three openings leading to spherical shaped toe supports, said lower surface having a fastening means for securing said toe separating structure to said base.

2. The improved sandal according to claim 1 wherein said attachment means is further defined as a hook & pile attachment mechanism secured to outer side surface of the distal end on said first strap and a hook & pile attachment mechanism secured to an inner side surface of the distal end on said second strap.

3. The improved sandal according to claim 1 wherein said first strap includes a bridge stand having a first end secured to said base and a second end secured to said distal end of said first strip, said bridge stand positionable between the two largest toes of a foot.

4. The improved sandal according to claim 1 wherein said upper surface is covered with a pile material.

5. The improved sandal according to claim 1 wherein said attachment means is further defined as a tongue and groove attachment wherein said base includes a groove with said divider having a tongue shaped lower surface operatively associated with said groove.

6. The improved sandal according to claim 1 wherein said divider is formed from sponge rubber.

7. An improved sandal characterized by a base formed from flexible foam rubber materials having a cushioned upper surface, a lower surface providing ground abrasion resistance and an outer perimeter edge shaped to accommodate a human foot, said improvement comprising:

an adjustable bridge strap, said strap formed from a first strip of flexible material having a proximal end secured to said base adjacent to a first side surface of said outer perimeter edge and a distal end extending outwardly therefrom, and a second strip of flexible material having a proximal end secured to said base adjacent to a second side surface of said outer perimeter edge and a distal end extending outwardly therefrom;

a bridge stand having a first end secured to said base and a second end secured to said distal end of said first strip, said bridge stand positionable between the two largest toes of a foot;

a hook & pile attachment mechanism secured to an outer side surface of the distal end on said first strap and a hook & pile attachment mechanism secured to an inner side surface of the distal end on said second strap;

a toe separating structure, said structure formed from a single piece of foam rubber having a rectangular shape with an upper surface and a lower surface, said upper surface having three openings leading to spherical shaped toe supports, said lower surface having a fastening means for securing said toe separating structure to said base.

* * * * *